US007255609B1

(12) United States Patent
Epstein

(10) Patent No.: US 7,255,609 B1
(45) Date of Patent: Aug. 14, 2007

(54) BIOMEDICAL ELECTRODE CONNECTOR DEVICE

(76) Inventor: Stephen T. Epstein, 10 Lakeview Dr., Newtown, PA (US) 18940

( * ) Notice: Subject to any disclaimer, the term of this patent is extended or adjusted under 35 U.S.C. 154(b) by 0 days.

(21) Appl. No.: 11/072,121

(22) Filed: Mar. 7, 2005

(51) Int. Cl.
*H01R 4/48* (2006.01)

(52) U.S. Cl. ..... 439/729; 439/909; 439/857

(58) Field of Classification Search ..... 439/729, 439/909, 859, 725, 857, 822
See application file for complete search history.

(56) References Cited

U.S. PATENT DOCUMENTS 5,407,368 A 4/1995 Strand et al. ..... 439/729
5,511,548 A 4/1996 Riazzi et al. ..... 128/641
5,624,281 A 4/1997 Christensson ..... 439/729
6,062,915 A 5/2000 Costello et al. ..... 439/729

*Primary Examiner*—Javaid H. Nasri
(74) *Attorney, Agent, or Firm*—Lamorte & Associates

(57) ABSTRACT

A connector assembly for connecting a wire lead to a biomedical electrode. The connector assembly has a base housing. A metal conductor is disposed within the base housing. The metal conductor is formed from a single piece of sheet metal, wherein the metal conductor has a flat front section and a rear section that is curved into at least one spring structure. A lever is provided that has a front end and a tail end. A locking pawl extends from the lever and locks the snap connection in place. The locking pawl can be released by pressing inwardly on the sides of the base housing. When the sides of the base housing are pressed together, wedge elements advance under the lever and lift the front of the lever. The result is a release mechanism that applied only a minimal amount of lateral forces to the biomedical electrode.

13 Claims, 5 Drawing Sheets

BIOMEDICAL ELECTRODE CONNECTOR DEVICE

BACKGROUND OF THE INVENTION

1. Field of the Invention

In general, the present invention relates to electrode connectors that are used to attach medical equipment leads to electrodes on a patient. More particularly, the present invention relates to the structure of such electrode connectors.

2. Description of the Prior Art

There are many types of medical equipment that gather and process electrical signals generated from within a patient's body. For instance, an electrocardiogram instrument detects electrical nerve impulses generated by the heart. Those detected impulses are then converted into a graphical representation so that the heart's nerve impulses can be viewed and analyzed by a doctor. Many other pieces of medical equipment exist that detect electrical impulses from other organs of the body, such as the brain, lungs and uterus.

In order for a piece of medical equipment to detect an electrical impulse from within the human body, some type of electrical lead must be attached between the medical equipment and the body. The electrical lead must mechanically attach to the body so that an electrical impulse generated within the body can be transmitted into the electrical lead and back to the medical equipment.

There are many types of electrical lead terminations that engage a patient's body and receive electrical impulses. Some of these prior art terminations are intrusive, in that they have an electrode lead that penetrates the skin or is introduced within an orifice of the body. However, for many types of medical testing, such as electrocardiograms, passive termination electrodes are used. A passive termination electrode is typically formed as a conductive pad. The conductive pad is glued, strapped or taped to the skin. The passive termination electrode detects electrical impulses through the skin without having to penetrate the skin. Such prior art passive termination electrodes are exemplified by U.S. Pat. No. 5,511,548 to Riazzi, entitled Biomedical Electrode Having A Secured One-Piece Conductive Terminal.

Passive termination electrodes that attach to the skin come in a wide assortment of sizes and configurations depending upon the intended application of the termination electrode. Passive termination electrodes are manufactured in two primary styles. In one style, the electrode is provided with a snap protrusion that allows a wire lead to be attached to the electrode with a snap connection. In a second style of electrode, no snap protrusion is provided. Rather, the electrode is either provided with a flap or is partially peeled away from the skin to form a free flap. The flap is then engaged with an alligator clip that attaches the electrode to a wire lead.

The style of connection present on the passive termination electrode depends upon the manufacturer of the electrode and the intended purpose of the electrode. The style of the connection present on the passive termination electrode must be matched with the connector on the medical equipment being used. If a piece of medical equipment has leads with snap connectors, then electrodes with snap connectors must be used. Similarly, if a piece of medical equipment has leads with alligator clip connectors, then electrodes with flaps must be used.

The medical field is flooded with equipment that uses leads terminated either with allegator clip connectors or snap connectors. Although the leads of such equipment can be changed, it is far less expensive to simply use the electrodes that match the connector type. As a result, many health care providers must purchase electrodes of different styles in order to accommodate the different types of equipment being used.

In the prior art, there are many patents for various types of electrode connector designs. For instance, U.S. Pat. No. 5,407,368 to Strand, entitled Electrode Connector and U.S. Pat. No. 6,062,915 to Costello, entitled Nondeforming Electrode Connector, both show typical prior art alligator clip connector designs.

In an attempt to simplify the logistics of providing different connectors for different types of electrodes, connectors have been designed that can be attached both to electrode snap connections and electrode flap connections. Such prior art connectors are exemplified by U.S. Pat. No. 5,624,281 to Christensson, entitled Clasp Structure For Biomedical Electrodes. A problem associated with such prior art electrode connectors is that they are very complex to manufacture, and are therefore expensive. The electrode connectors on a piece of equipment are changed from time-to-time. In certain situations, the electrode connectors are replaced after every use. Thus, the cost of the electrode connectors is a large concern. Furthermore, in many prior art electrode connectors, the wire lead that attaches to the testing equipment is permanently attached to the electrode connector. As a result, the wires leads must be replaced each time the electrode connectors are replaced. This also adds significantly to the costs of operation.

Another problem associated with prior art electrode connectors is that they apply significant forces to the passive termination electrode as the electrode connectors are attached and detached from the electrode connectors. For instance, snap connectors must be pressed hard against a passive termination electrode in order to engage the snap connection with the passive termination electrode. This applied force often acts to move the passive termination electrode. Similarly, alligator clip connectors must be squeezed to open the jaws of the clip. Often, when a person's fingers try to fit around the alligator clip connector to squeeze it open, the alligator clip connector pulls on the passive electrode connector and pulls the passive electrode connector away from the person's skin.

A need therefore exists in the art for an electrode connector that is very inexpensive, yet can attach to both snap connection electrodes and flap connection electrodes.

A need also exists for a low cost electrode connector that can be easily detached from wire leads so that the electrode connector can be replaced without having to replace the wire leads.

Lastly, a need exists for an electrode connector with an improved attachment/detachment mechanism that allows the electrode connector to be attached and detached from an electrode connector without disrupting the electrode connector.

These needs are met by the present invention as described and claimed below.

SUMMARY OF THE INVENTION

The present invention is a connector assembly for connecting a wire lead to a biomedical electrode. The connector assembly has a base housing. A metal conductor is disposed within the base housing. The metal conductor is formed from a single piece of sheet metal, wherein the metal conductor has a flat front section and a rear section that is curved into at least one spring structure.

A lever is provided that has a front end and a tail end. The lever is pivotably coupled to the base housing at a point in between the front end and the tail end of the lever. The front end of the lever is biased against the flat front section of the metal conductor by the spring structure.

The connector assembly can be attached to biomedical electrodes having either flap connections or snap connections. To attach the assembly to an electrode with a flap connection, the flap connection is placed in between the front end of the lever and the metal conductor. The lever biases the flap connection against the metal conductor, therein creating the needed electrical interconnection. To attach the assembly to an electrode with a snap connection, the snap connection is advanced through an access hole in the base housing. A locking pawl extends from the lever and locks the snap connection in place. The locking pawl can be released by pressing inwardly on the sides of the base housing.

When the sides of the base housing are pressed together, wedge elements advance under the lever and lift the front of the lever. This action moves the locking pawl away from the snap connection. The result is a release mechanism that applied only a minimal amount of lateral forces to the snap connection, thereby helping the electrode stay seated on the skin of the patient.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Figure 1:
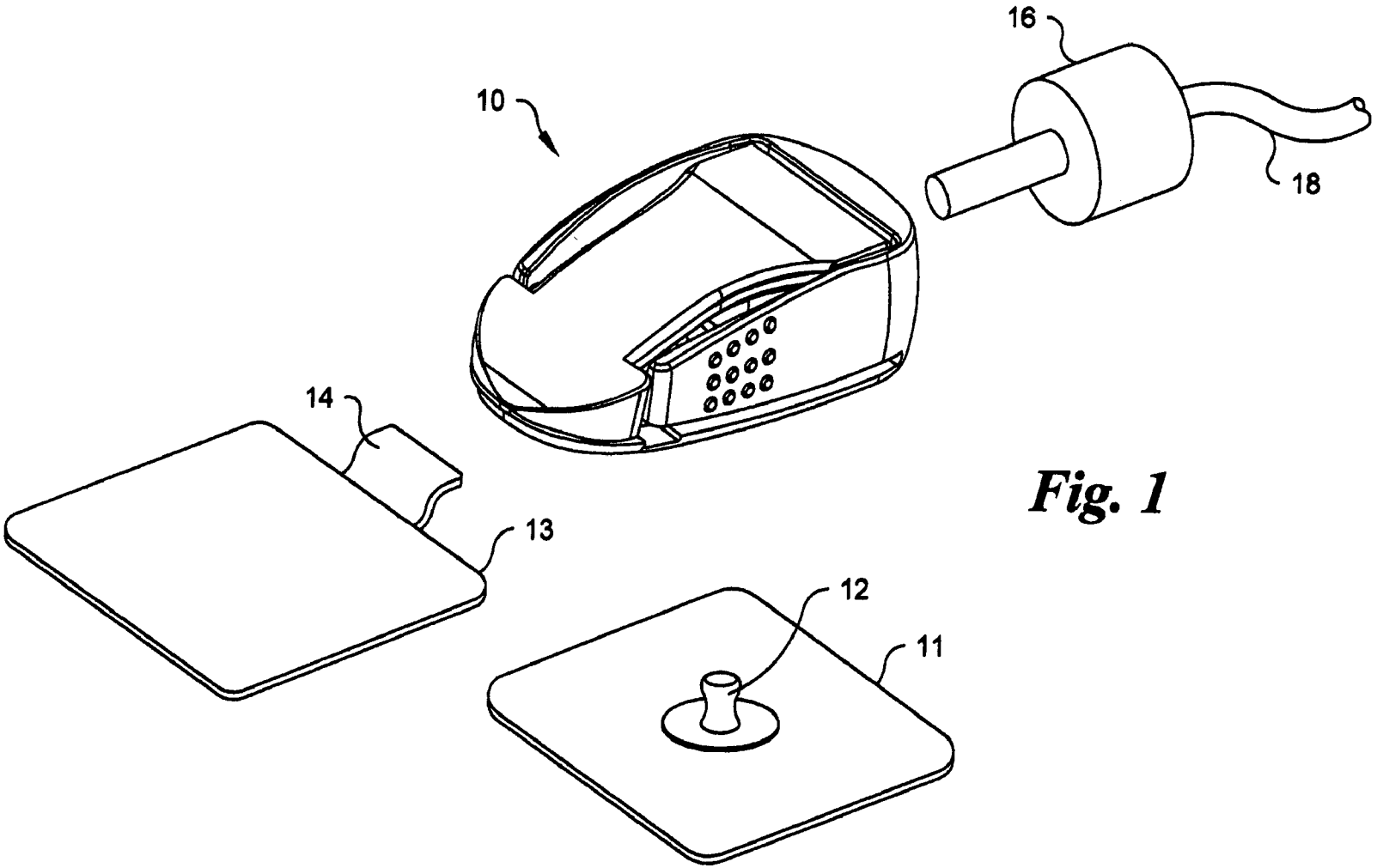
FIG. 1 is a perspective view of an exemplary embodiment of the present invention shown in conjunction with two styles of biomedical electrodes.

Referring to FIG. 1, an exemplary embodiment of the present invention electrode connector assembly 10 is shown. The electrode connector assembly 10 can attach to either an electrode 11 with a snap connection 12 or an electrode 13 with a flap connection 14. Furthermore, the electrode connector assembly 10 is itself configured to receive a separate pin connector 16. The pin connector 16 is attached to a wire lead 18 that extends from a piece of medical equipment. The pin connector 16 can be selectively attached and detached from the electrode connector assembly 10. Accordingly, the electrode connector assembly 10 can be replaced without having to replace the wire leads 18 of the medical equipment.

Figure 2:
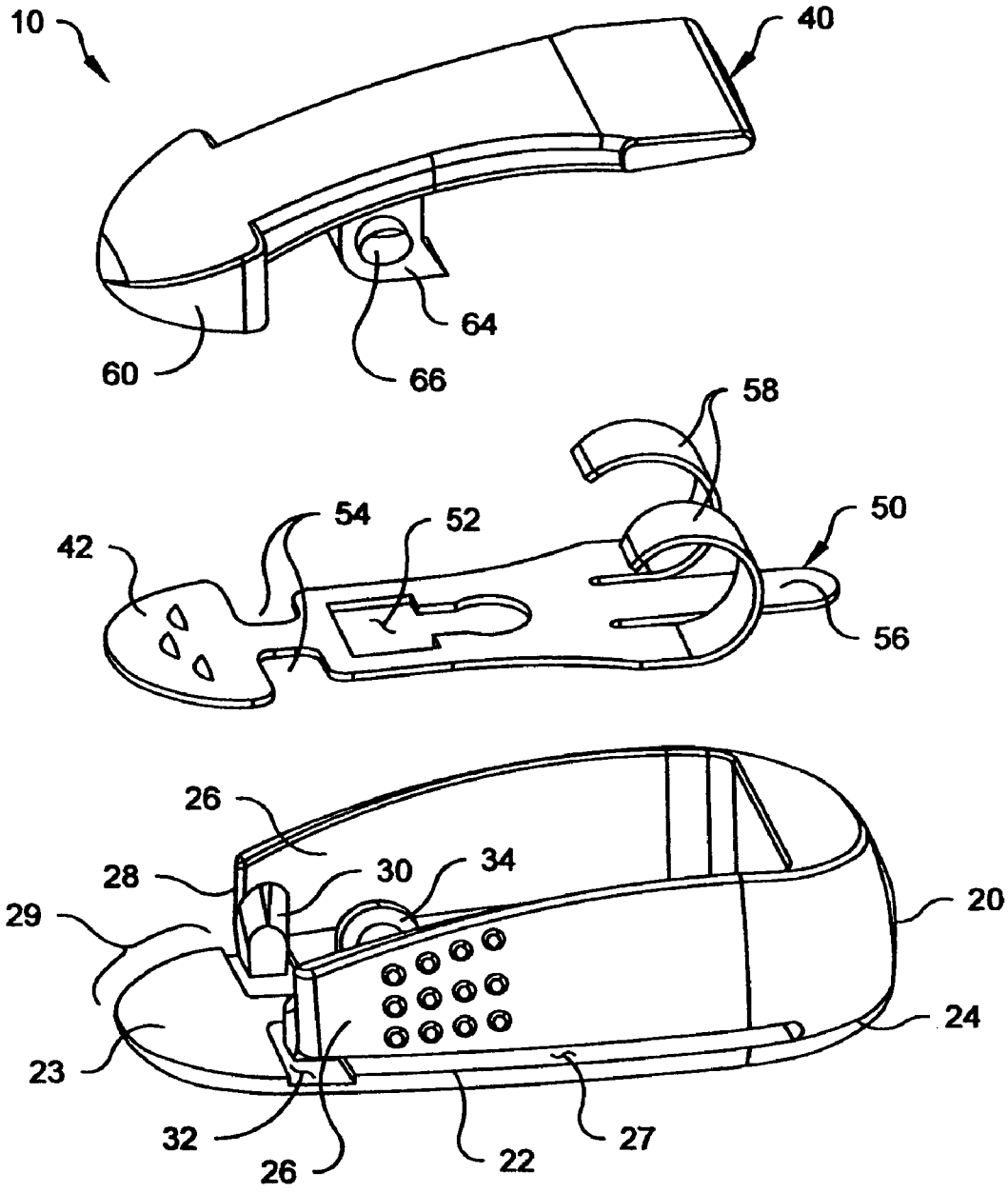
FIG. 2 is an exploded perspective view of the exemplary embodiment of the connector assembly shown in FIG. 1.

The electrode connector assembly 10 is specifically designed to be very low cost. Referring to FIG. 2, it can be seen that the electrode connector assembly 10 is comprised of only three pieces. Those pieces included a plastic molded base housing 20, a plastic molded top lever 40 and a stamped metal conductor 50.

The base housing 20 has a bottom surface 22 that is mostly flat. The bottom surface 22 has a front end 23 and a back end 24. Side walls 26 are present as part of the base housing 20. However, the side walls 26 are only interconnected to the bottom surface 22 near the back end 24 of the flat bottom surface 22. Consequently, the side walls 26 are cantilevered and a gap 27 exists between the side walls 26 and the flat bottom surface 22 along most of the length of the side walls 26.

The side walls 26 have forward ends 28 that face the front end 23 of the bottom surface 22. The side walls 26 are not as long as the bottom surface 22. As a result, the bottom surface 22 protrudes forward of the side walls 26, therein creating a front protruding section 29. Sloped wedges 30 are disposed on the side walls 26 at their forward ends 28. The sloped wedges 30 extend laterally and therefore face each other. Depressions 32 are formed in the bottom surface 22 under the sloped wedges 30. The depressions 32 allow the sloped wedges 30 to freely move when the side walls 26 are biased together.

Pivot yokes 34 extend upwardly from the bottom surface 22 in between the side walls 26. The pivot yokes 34 are used to engage the top lever 40, as will later be explained. In between the pivot yokes 34, an access hole (not shown) is provided that extends through the bottom surface 22 near its center.

The stamped metal conductor 50 is stamped from a sheet of electrically conductive metal, such as copper, aluminum or steel. The stamped metal conductor 50 fits within the base housing 20 and lay upon the bottom surface 22. The stamped metal conductor 50 has a head section 42 that lay upon the front protruding section 29 of the bottom surface 22. In the middle of the stamped metal conductor 50 is a hole 52 that aligns over the access hole (not shown) in the bottom surface 22. The stamped metal conductor 50 also defines two recesses 54 that align with the sloped wedges 30 on the side walls 26, so that the metal conductor 50 does not interfere with the free movement of the sloped wedges 30 when the side walls 26 are biased together.

At the rear of the stamped metal conductor 50, the stamped metal conductor 50 is formed into three tabs. The center tab 56 lay flat. The side tabs are bent into curved springs 58. The purpose of such a configuration is later described.

The top lever 40 is shaped as a jaw head 60 at its front end. The tail end 62 of the top lever 40 is wide and flat so that it can be easily pressed by a person's finger. A locking pawl 64 extends downwardly from the top lever 40 at a point in between the jaw head 60 and the tail end 62. Pivot protrusions 66 extend laterally from the sides of the locking pawl 64. The pivot protrusions 66 are received by the pivot yokes 34 in the base housing 20.

Figure 3:
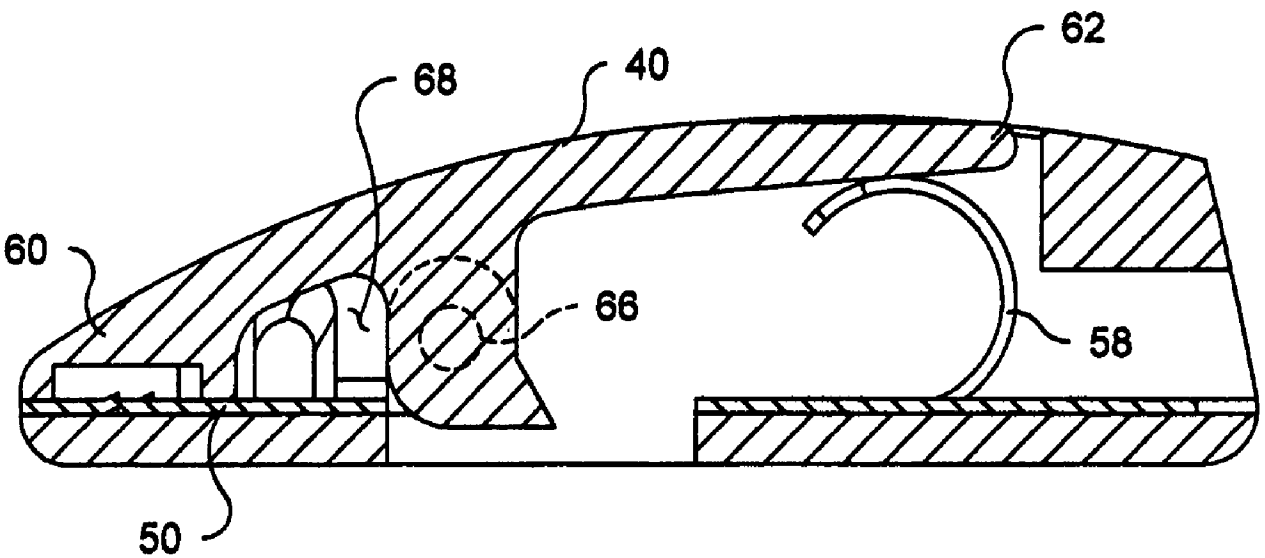
FIG. 3 is a cross-sectional view of the connector assembly shown in FIG. 1 and FIG. 2.

Referring to FIG. 3, it can be seen that when assembled, the pivot protrusions 66 act as the fulcrum point to the top lever 40, wherein the top lever 40 can teeter about the pivot protrusions 66. The tail end 62 of the top lever 40 rests upon the curved springs 58. At this position, the jaw head 60 of the top lever 40 is biased against the head section 42 of the stamped metal conductor 50. It will therefore be understood that to lift the jaw head 60 up and away from the head section 42 of the metal conductor 50, the tail end 62 of the top lever 40 can be pressed downwardly with enough force to temporarily deform the curved springs 58.

In FIG. 3, it can also be seen that an open space 68 is provided within the top lever 40 that aligns with the sloped wedges 30. This open space 68 is sized so that when the sloped wedges 30 are biased toward one another, they engage the top lever 40 behind the jaw head 60 and bias the jaw head 60 upwardly in opposition to the bias of the curved springs 58. It will therefore be understood that when the side walls 26 are squeezed together, the sloped wedges 30 bias the jaw head 60 upwardly and cause the electrode connector assembly 10 to disengage the snap connection 12. Thus, by squeezing the side walls of the electrode connector assembly 10 together, the electrode connector assembly 10 can be conditioned to either engage or disengage a snap connector 12 while applying only minimal forces to the snap connector 12. The attachment and detachment of the electrode connector assembly 10, therefore, is unlikely to unseat the electrode 11.

Figure 4:
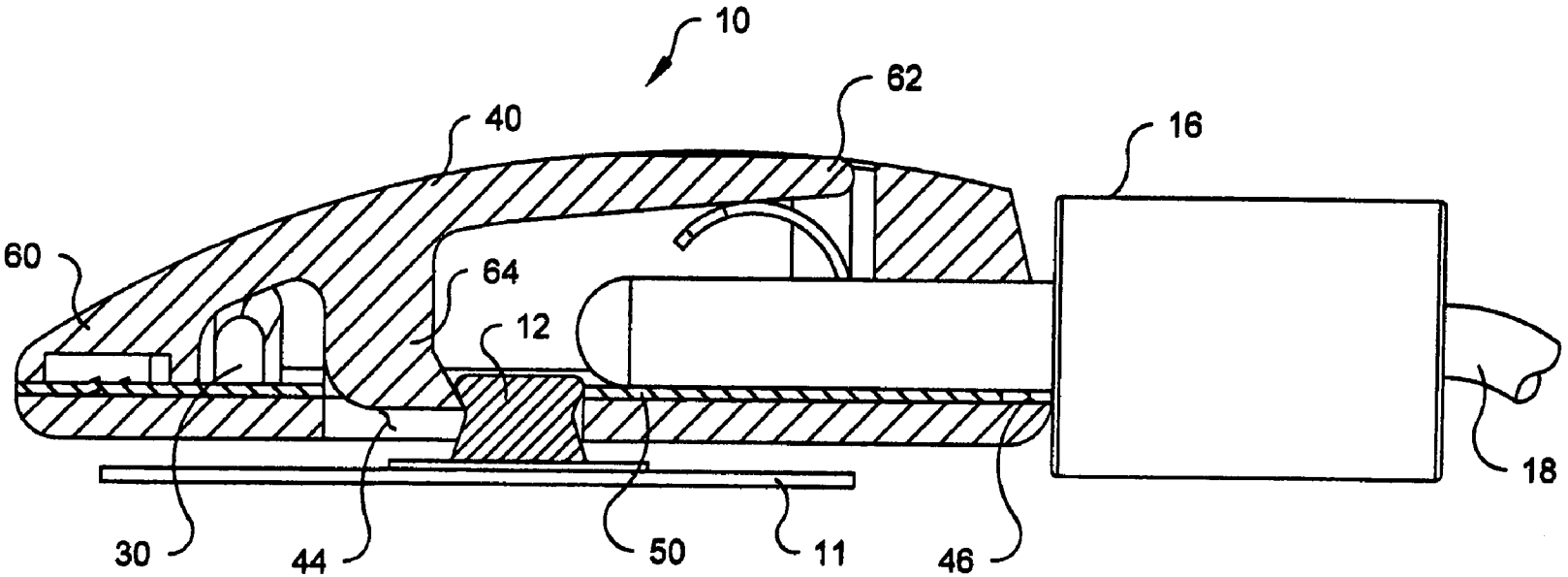
FIG. 4 is the same view as FIG. 3 with the connector assembly shown engaging a biomedical electrode with a snap connection.

Referring to FIG. 4, the electrode connector assembly 10 is shown engaging an electrode 11 having a snap connection 12. The snap connection 12 is advanced through the access hole 44 in the bottom surface 22 of the base housing 20. The snap connection 12 becomes locked in place by the engagement of the locking pawl 64. Once locked into place, the snap connection 12 is biased against the stamped metal conductor 50, thereby creating an electrical interconnection between the snap connection 12 and the stamped metal conductor 50.

The snap connection 12 is locked in place within the electrode connector assembly 10. To release the snap connection 12, either the tail end 62 of the top lever 40 must be directly depressed, or the sloped wedges 30 must be pressed together to bias the jaw head 60 upwardly. Either maneuver rotates the locking pawl 64 away from the snap connection 12 and releases the snap connection 12.

The pin connector 16 is connected to the wire lead 18 from some piece of medical equipment. The pin connector 16 is inserted into a receiving hole 46 in the back of the base housing 20. The pin connector 16 rests upon the stamped metal conductor 50, thereby creating the needed electrical interconnection. The pin connector 16 is held in place by a frictional fit. In this manner, the pin connector 16 can be selectively added to, or removed from, the electrode connector assembly 10 as needed.

Figure 5:
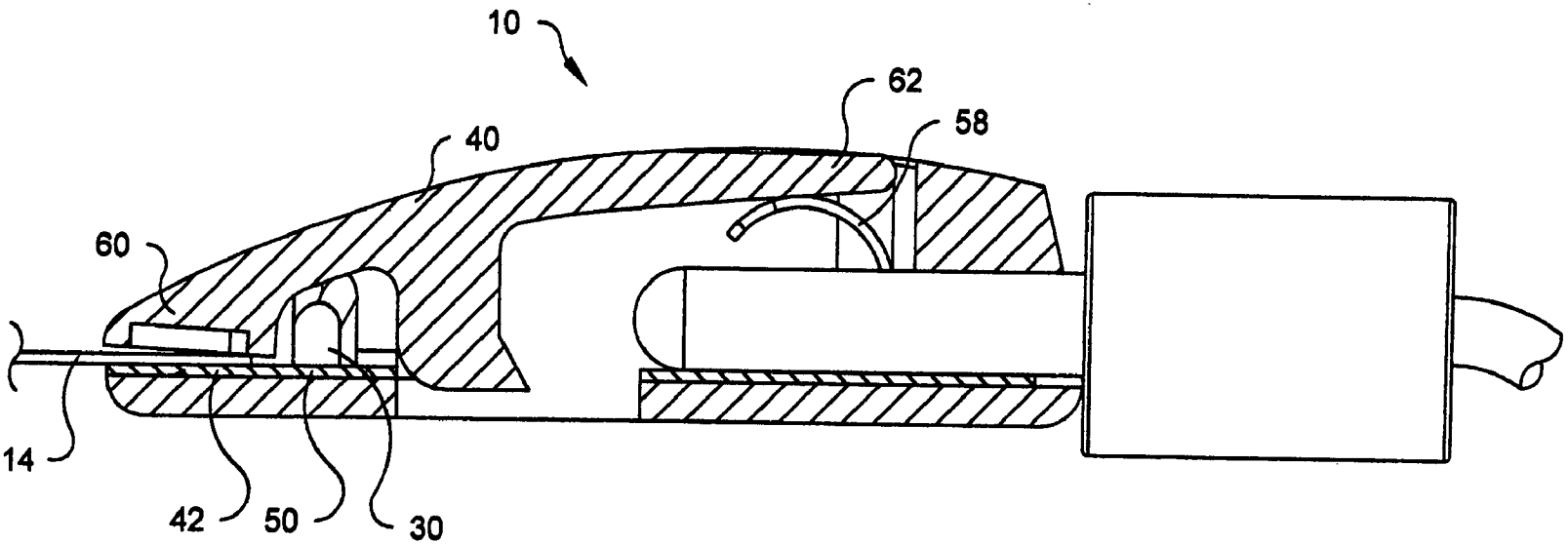
FIG. 5 is the same view as FIG. 3 with the connector assembly shown engaging a biomedical electrode with a flap connection.

Referring to FIG. 5, the electrode connector assembly 10 is shown engaging an electrode having a flap connection 14. The flap connection 14 is advanced under the jaw head 60 of the top lever 40 so that the flap connection 14 is interposed between the jaw head 60 and the head section 42 of the stamped metal conductor 50. The jaw head 60 is biased against the stamped metal conductor 50 by the curved springs 58. Once locked into place, the flap connection 14 is biased against the stamped metal conductor 50, thereby creating an electrical interconnection between the flap connection 14 and the stamped metal conductor 50.

To release the flap connection 14, either the tail end 62 of the top lever 40 must be directly depressed, or the sloped wedges 30 must be pressed together to bias the jaw head 60 upwardly. Either maneuver raises the jaw head 60 away from the flap connection 14, thereby releasing the flap connection 14.

It will be understood that the embodiment of the present invention electrode connector assembly that has been described and illustrated is merely exemplary, and that a person skilled in the art can make many modifications to the shown design using functionally equivalent components. For instance, the shapes selected for the various components are a matter of design choice and it is known that the electrode connector assembly can be made with other shapes. Furthermore, although the electrode connector assembly is shown with a separate pin connector, it will be understood that a wire lead can be directly and permanently attached to the electrode connector assembly. All such variations, modifications and alternate embodiments are intended to be included within the scope of the present invention, as represented by the claims.

What is claimed is:

1. A connector assembly for connecting a wire lead to a biomedical electrode, said assembly comprising:

a base housing having a bottom surface, opposing side wall structures, and wedges that extend inwardly from said side wall structures;

a metal conductor disposed within said base housing, said metal conductor having a front section and a rear section, wherein said rear section is curved into at least one spring structure;

a lever having a front end and a tail end, wherein said lever is pivotably coupled to said base housing in between said front end and said tail end, and wherein said wedges on said opposing side wall structures contact said lever biasing said front end of said lever upwardly when said opposing side wall structures are pressed toward each other.

2. The assembly according to claim 1, wherein said at least one spring structure biases said tail end of said lever upwardly, therein biasing said front end of said lever against said flat front section of said metal conductor.

3. The assembly according to claim 1, wherein said bottom surface of said base housing defines an access hole that extends through said bottom surface for receiving a snap connection from a biomedical electrode.

4. The assembly according to claim 3, wherein said metal conductor defines a hole that aligns with said access hole in said bottom surface of said base housing.

5. The assembly according to claim 1, further including a locking pawl that extends downwardly from said lever into said base housing.

6. The assembly according to claim 5, wherein said locking pawl moves in position relative said base housing as said lever moves.

7. The assembly according to claim 1, wherein said metal conductor is stamped from a single piece of sheet metal.

8. The assembly according to claim 1, further including a pin connector that is coupled to the wire lead of the medical equipment, wherein said base housing selectively receives said pin connector and wherein said metal conductor abuts against said pin connector when said pin connector is disposed within said base housing.

9. The assembly according to claim 8, further including a rear access port in said base housing for receiving said pin connector with a frictional fit.

10. A connector assembly for connecting a wire lead to a snap connection on a biomedical electrode, said assembly comprising:

a base housing having a bottom surface, two side wall structures, and wedges that extend inwardly from said side wall structures, wherein an access hole is disposed through said bottom surface for receiving the snap connection from the biomedical electrode;

a conductor disposed within said base housing that contacts said snap connection when said snap connection is advanced through said access hole;

a lever having a front end, a tail end and a locking pawl extending downwardly from said lever, said lever being pivotably coupled to said base housing, wherein said locking pawl moves between a locking position and a free position as said lever pivots, wherein said locking pawl engages said snap connection and locks said snap connection within said access hole of said base housing when said locking pawl is in said locking position; and wherein said wedges contact said lever and bias said locking pawl toward said free position when said wedges are moved toward each other.

11. The assembly according to claim 10, wherein said locking pawl disengages said snap connection when said locking pawl moves from said locking position to said free position.

12. The assembly according to claim 10, wherein said locking pawl is biased into said locking position by at least one spring.

13. The assembly according to claim 12, wherein said conductor is formed from a single piece of sheet metal, wherein said conductor has a section that is curved to form said at least one spring.

* * * * *